US006227457B1

(12) United States Patent
Oliver

(10) Patent No.: US 6,227,457 B1
(45) Date of Patent: May 8, 2001

(54) IMPACT FEATURE FOR AN ARMATURE IN A FUEL INJECTOR

(75) Inventor: Jack David Oliver, Williamsburg, VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 09/470,983

(22) Filed: Dec. 23, 1999

(51) Int. Cl.[7] ..... F02M 51/00

(52) U.S. Cl. ..... 239/5; 239/585.1

(58) Field of Search ..... 239/585.1, 585.2, 239/585.3, 585.4, 585.5, 463, 468; 251/129.15, 129.21

(56) References Cited

U.S. PATENT DOCUMENTS

| | | | | |
|---|---|---|---|---|
| 5,033,716 | * | 7/1991 | Mesenich | 251/129.21 |
| 5,375,772 | * | 12/1994 | Cristiani et al. | 239/585.4 |
| 5,427,319 | * | 6/1995 | Bata | 239/585.4 |
| 6,065,692 | * | 5/2000 | Brinn, Jr. | 239/585.4 |

* cited by examiner

*Primary Examiner*—David A. Scherbel
*Assistant Examiner*—Christopher S. Kim

(57) ABSTRACT

A fuel injector having a housing, an armature, and an inlet member, and a needle. The housing has a fuel inlet, a fuel outlet, and a fuel passageway extending from the fuel inlet to the fuel outlet along a longitudinal axis. The inlet member is disposed within the fuel passageway. The armature is also disposed within the fuel passageway. The needle is operatively connected to the armature, and is positionable to permit or inhibit fuel flow through the fuel outlet. A first surface is located on one of the inlet member or the armature. The first surface has a first perimeter located on a first plane that is substantially perpendicular to the longitudinal axis. A second surface, which is exposed to the first surface, is located on the other of the inlet member and the armature. The second surface has a second perimeter at least partially located on a second plane that is oblique to the longitudinal axis. The first surface and the second surface provide a method of mechanically enhancing motion of components of a fuel injector. The method is achieved by engaging the first surface and the second surface so that the central axis of the armature and needle assembly is at least partially offset from the longitudinal axis of the fuel injector.

15 Claims, 3 Drawing Sheets

IMPACT FEATURE FOR AN ARMATURE IN A FUEL INJECTOR

BACKGROUND OF THE INVENTION

This invention relates in general to valve assemblies, and, in particular, fuel injectors having a swirl generator. More particularly to high-pressure, direct-injection fuel injectors required to meter accurate and repeatable amounts of fuel for any given injection pulse.

SUMMARY OF THE INVENTION

The present invention provides a fuel injector having a housing, an armature, and an inlet member, and a needle. The housing has a fuel inlet, a fuel outlet, and a fuel passageway extending from the fuel inlet to the fuel outlet along a longitudinal axis. The inlet member and the armature is disposed within the fuel passageway. The needle is operatively connected to the armature, and is positionable to permit or inhibit fuel flow through the fuel outlet.

A first surface is located on one of the inlet member and the armature. The first surface has a first perimeter located on a first plane that is substantially perpendicular to the longitudinal axis. A second surface, which is exposed to the first surface, is located on the other of the inlet member and the armature. The second surface has a second perimeter at least partially located on a second plane that is oblique to the longitudinal axis.

In a preferred embodiment, the second surface has an engagement face and a relieved face. The engagement face is located proximate the second perimeter. The engagement face is a planar surface that is substantially perpendicular to the longitudinal axis. The relieved face, preferably, is a planar surface that is offset along the longitudinal axis and substantially parallel to the planar surface of the engagement face, or a planar surface that is oblique to the longitudinal axis.

The present invention also provides a method of mechanically enhancing motion of components of a fuel injector. The fuel injector includes a housing, an inlet member, an armature and needle assembly, a first support member, and a second support member. The housing has a fuel inlet, a fuel outlet, and a fuel passageway extending from the fuel inlet to the fuel outlet along a longitudinal axis. The inlet member provides the fuel inlet of the housing. The armature and needle assembly is disposed within the passageway, and has a central axis substantially aligned with the longitudinal axis. The first support member is provided for the armature, and the second support member is provide for the needle. The method of the present invention is achieved by providing a first surface on one of the inlet member and the armature; providing a second surface on the other of the inlet member and the armature; and engaging the first surface and the second surface so that the central axis is at least partially offset from the longitudinal axis of the fuel injector.

In a preferred embodiment of the method, an engagement face and a relieved face is arranged on the second surface. The engagement face is a planar surface that is substantially perpendicular to the central axis, and the relieved face is either a planar surface that is offset along the longitudinal axis and is substantially parallel to the planar surface of the engagement face or, a planar surface that is oblique to the longitudinal axis. Preferably, the first surface is located on the inlet member and the second surface is located on the armature, an armature guide eyelet is provided as the first support member, and the at least one flat guide disk is provided as the second support member.

BRIEF DESCRIPTION OF THE DRAWINGS

The accompanying drawings, which are incorporated herein and constitute part of this specification, illustrate presently preferred embodiments of the invention, and, together with the general description given above and the detailed description given below, serve to explain features of the invention.

DETAILED DESCRIPTION OF THE PREFERRED EMBODIMENTS

Figure 1:
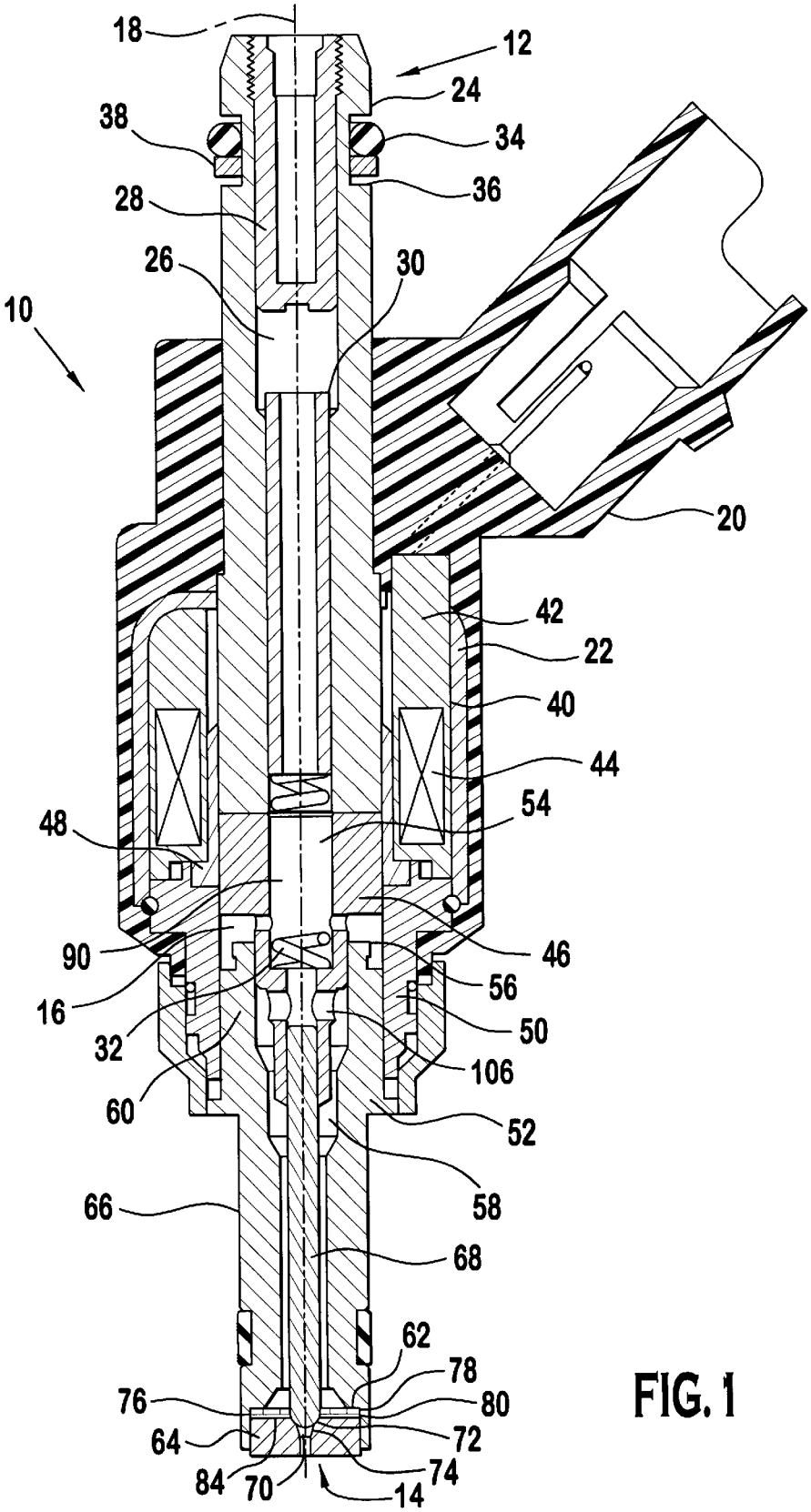
FIG. 1 is a cross-sectional view of a fuel injector, of a fuel injector of the present invention taken along its longitudinal axis.

FIG. 1 illustrates a fuel injector of a preferred embodiment, which is, preferably, a high-pressure, direct-injection fuel injector. The fuel injector 10 has a housing, which includes a fuel inlet 12, a fuel outlet 14, and a fuel passageway 16 extending from the fuel inlet 12 to the fuel outlet 14 along a longitudinal axis 18. The housing has an over-molded plastic member 20 cincturing a metallic support member 22. A fuel inlet member 24, with an inlet passage 26 extending between an entrance and an exit, is disposed within the overmolded plastic member 20. The inlet passage 26 serves as part of the fuel passageway 16 of the fuel injector 10. A fuel filter 28 and an adjustable tube 30 is provided in the inlet passage 26 at the entrance of the inlet member 24, which provides the fuel inlet 12. The adjustable tube 30 is positionable along the longitudinal axis 18 before being secured in place to vary the length of an armature bias spring 32, which controls the quantity of fluid flow within the fuel injector 10. The over-molded plastic member 20 also supports an electrical socket that receives a plug (not shown) to operatively connect the fuel injector 10 to an external source of electrical potential, such as an electronic control unit ECU (not shown). An elastomeric o-ring 34 is provided in a groove 36 on an exterior portion of the inlet member 24. The o-ring 36 is biased by a flat spring 38 to sealingly secure the inlet member 24 with a fuel supply member, such as a fuel rail (not shown).

The metallic support member 22 encloses a coil assembly 40. The coil assembly 40 includes a bobbin 42 that retains a coil 44. The ends of the coil assembly 40 are operatively connected to the electrical socket through the over-molded plastic member 20. An armature 46 is disposed within the fuel passageway 16 and is axially aligned with the inlet member 24 by a spacer 48, a body shell 50, and a body 52.

The armature 46 has an armature passage 54 aligned along the longitudinal axis 18 with the inlet passage 26 of the inlet member 24 proximate the exit of the inlet member 24. The spacer 48 engages the body shell 50. An armature guide eyelet 56 is located on an inlet portion 60 of the body 52, and provides a support for the armature. The armature guide eyelet 56 is configured to allow fluid communication between the armature guide eyelet 56 and the armature 46.

An axially extending body passage 58 connects the inlet portion 60 of the body 52 with an outlet portion 62 of the body 52. The armature passage 54 of the armature 46 is axially aligned with the body passage 58 of the body 52 along the longitudinal axis 18. A seat 64, which is preferably a metallic material, is located at the outlet portion 62 of the body 52. The body 52 has a neck portion 66, which is, preferably, a cylindrical annulus that surrounds a needle 68. The needle 68 is operatively connected to the armature 46, and, in a preferred embodiment, is a substantially cylindrical needle. The cylindrical needle is centrally located within the cylindrical annulus. The cylindrical needle 68 is axially aligned with the longitudinal axis 18 of the fuel injector 10.

The armature 46 is magnetically coupled to the inlet member 24 near the inlet portion 60 of the body 52. A portion of the inlet member 24 proximate the armature 46 serves as part of the magnetic circuit formed with the armature 46 and coil assembly 40. The armature 46 is guided in the armature guide eyelet 56 and is responsive to an electromagnetic force generated by the coil assembly 40, which axially reciprocates the armature 46 along the longitudinal axis 18 of the fuel injector 10. The electromagnetic force is generated by current flow from the ECU through the coil assembly 40. During operation of the fuel injector 10, the needle 68 engages the seat 64, which opens and closes a seat passage 70 of the seat 64 to permit or inhibit, respectively, fuel from exiting the fuel outlet 14 of the fuel injector 10. The needle 68 includes a curved surface, which is preferably a spherical surface, that mates with the conical end 72 of a funnel 74, that serves as the preferred seat passage 70 of the seat 64. A swirl generator 76 is located in the body passage 58 proximate the seat 64. The swirl generator 76 allows the fuel to form a swirl pattern on the seat 64. In particular, for example, the fuel is swirled on the conical end 72 of the funnel 74 in order to produce a desired spray pattern. The swirl generator 76, preferably, is constructed from a pair of flat disks, a guide disk 78 and a swirl disk 80. The guide disk 78 provides a support for the needle 68.

The needle 68 is guided in a central aperture of the guide disk 78. The guide disk 78 has a plurality of fuel passage openings that supply fuel from the body passage 58 to the swirl disk 80. The swirl disk 80 directs fuel from the fuel passage openings in the guide disk 78 and meters the flow of fuel tangentially toward the seat passage 70 of the seat 64. The guide disk 78 and swirl disks 80 that form the swirl generator 76 are secured to a first surface 84 of the seat 64, preferably, by laser welding. The fuel to be injected from the fuel injector 10 flows in fluid communication from the fuel inlet source (not shown) through the fuel inlet 12 passage of the inlet member 24, the armature passage 54 of the armature 46, the body passage 58 of the body 52, the guide disk 78 and the swirl disk 80 of the swirl generator 76, and the seat passage 70 of the seat 64.

The armature passage 54 of the armature 46 includes a first portion 90 and a second portion 92. The first portion 90 has a first cross-sectional area. The second portion 92 has a second cross-sectional area. The first cross-sectional area of the first portion 90 is greater than the second cross-sectional area of the second portion 92. The armature bias spring 32 is disposed within the first portion 90 of the armature passage 54. The needle 68 is disposed within the second portion 92 of the of the armature passage 54.

A first surface 100 is located on one of the inlet member 24 and the armature 46. The first surface 100 has a first perimeter 102 located on a first plane P1 that is substantially perpendicular to the longitudinal axis 18. A second surface 104, which is exposed to the first surface 100, is located on the other of the inlet member 24 and the armature 46. The second surface 104 has a second perimeter 106 at least partially located on a second plane P2 that is oblique to the longitudinal axis 18.

Figure 2:
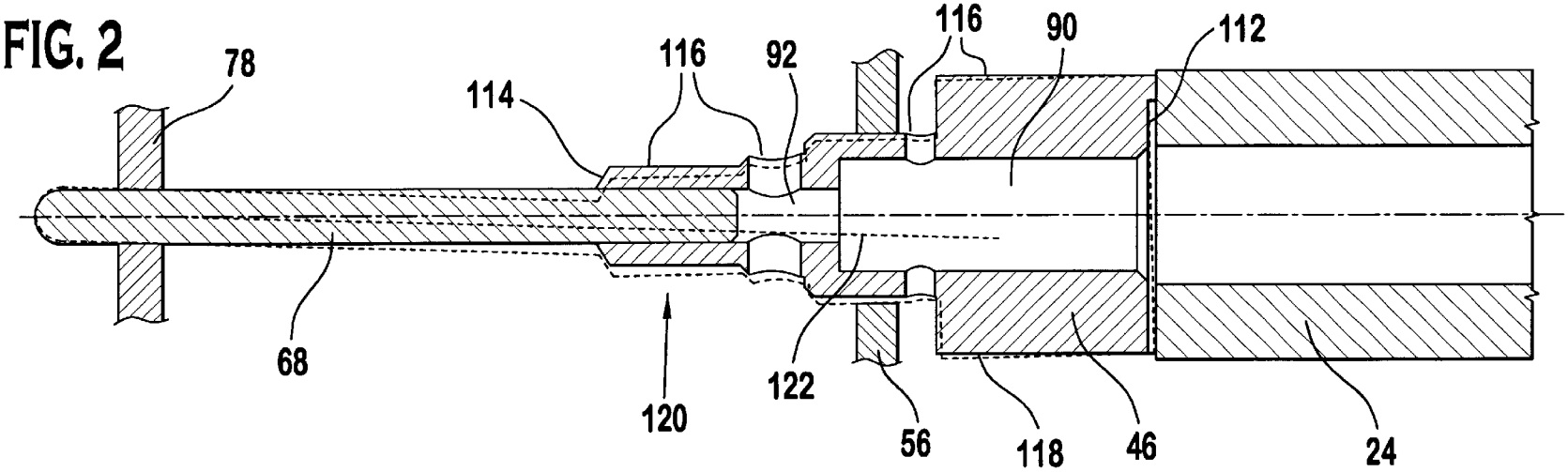
FIG. 2 is an enlarged cross-sectional view of the armature and inlet member of the fuel injector shown in FIG. 1.
Figure 5:
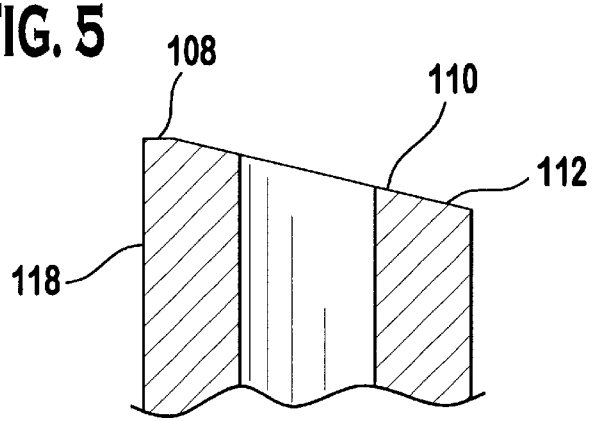
FIG. 5 is a side view of an alternative embodiment of the armature shown in FIG. 2.
Figure 3:
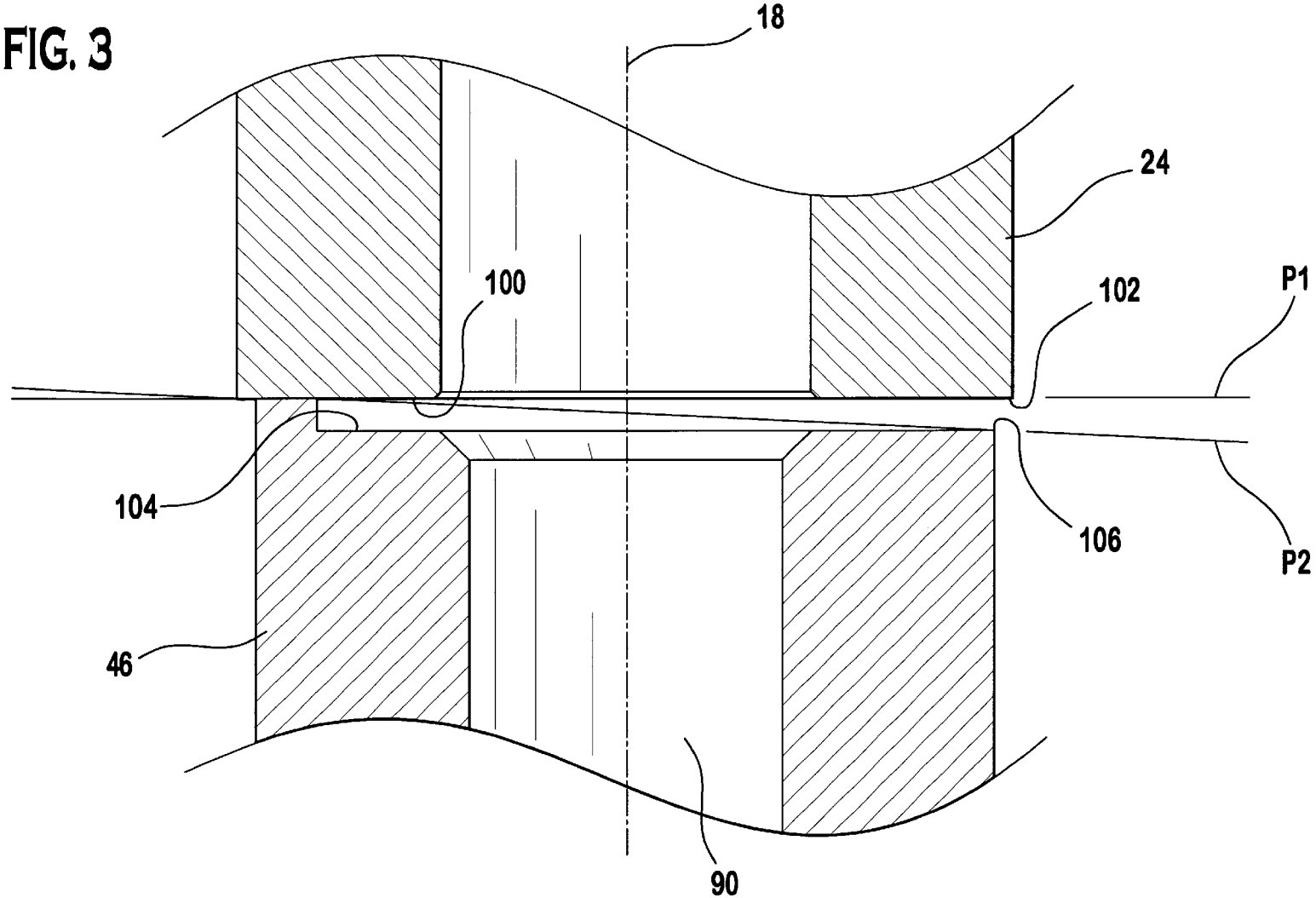
FIG. 3 is an enlarged view of the cross-sectional view of the armature and inlet member shown in FIG. 2.

In a preferred embodiment, the second surface 104 has an engagement face 108 and a relieved face 110. The engagement face 108 is located proximate the second perimeter 106. The engagement face 108 is a planar surface that is substantially perpendicular to the longitudinal axis 18. The relieved face 110, preferably, is a planar surface that is offset along the longitudinal axis 18 from the planar surface of the engagement face 108 and substantially parallel to the planar surface of the engagement face 108, as shown in FIGS. 2 and 3, or a planar surface that is oblique to the longitudinal axis 18, as shown in FIG. 5.

Figure 4:
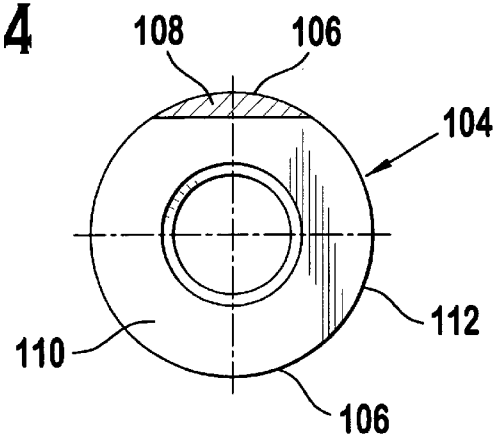
FIG. 4 is a top view of the armature shown in FIG. 2.

The first surface 100 is, preferably, located proximate the exit of the inlet member 24 and the second surface 104 is, preferably, located on the armature 46. Although, as shown in FIG. 3, in the preferred embodiment, the first surface 100 is disposed on the inlet member 24 and the second surface 104 is disposed on the armature 46, the opposite arrangement could be employed. That is, the first surface 100 could be located on the armature 46 and the second surface 104 could be located on the inlet member 24. The armature 46 is a substantially cylindrical member having a first end surface 112, a second end surface 114, a plurality of sections 116 between the first end surface 112 and the second end surface 114 that provide a side surface 118. The first end surface 112 includes the engagement face 108 and the relieved face 110 of the second surface 104. Each of the first perimeter 102 and the second perimeter 106 have a circular configuration, and the engagement face 108 and the relieved face 110 are sectors. The sectors provide the engagement face 108 and the relieved face 110, as shown in FIG. 4, in a first embodiment, on substantially parallel planes, and, as shown in FIG. 5, in a second embodiment, the sectors provide the engagement face 108 and the relieved face 110 on intersecting oblique planes. The sectors employed for the engagement face 108 and relieved face 110 provide the perimeter 106. Because the engagement face 108 and the relieved face 110, as shown in the alternative embodiments of FIGS. 4 and 5, are on different planes, the plane P2 passes through a portion of the perimeter 106. For purposes of the preferred embodiments, it is to be understood that the plane P2 is defined as a plane which passes through both the portions of the perimeter 106 that are diametrically opposed on the second face 104, and located respectively on the engagement face 108 and the relieved surface 110.

The first surface 100 and the second surface 104 provide a method of mechanically enhancing motion of components of a fuel injector. The fuel injector, preferably, includes a housing, an inlet member 24, an armature and needle assembly 120, which is formed from the operative connection of the armature 46 and the needle 68, a first support member, and a second support member. The housing has a fuel inlet, a fuel outlet, and a fuel passageway extending from the fuel inlet to the fuel outlet along a longitudinal axis 18. The inlet member 24 provides the fuel inlet of the housing. The armature and needle assembly 120 is disposed within the passageway, and has a central axis 122 substantially aligned with the longitudinal axis 18. The first support member is provided for the armature 46, which is, preferably, armature guide eyelet 56, and the second support member is provide for the needle 68, which is, preferably, lower guide 78. The method is achieved by providing the first surface 100 on one of the inlet member 24 and the armature 46; providing the second surface 104 on the other of the inlet member 24 and the armature 46; and engaging the first surface 100 and the second surface 104 so that the central axis is at least partially offset from the longitudinal axis 18 of the fuel injector as shown in FIG. 2 by the dashed outline of the assembly 120 and the central axis 122.

It is believed that the combination of the first support member, armature guide eyelet 56, and the second support member, lower guide 78, in addition to, the operative connection between the armature 46 and the needle 68 allow the central axis of the needle and armature assembly 102 to deflect from the longitudinal axis 18 of the fuel injector 10 when the first surface 100 engages the second surface 104. The deflection of the central axis from the longitudinal axis 18 is believed to yieldably deform the components such that when the first surface 100 and the second surface 104 are engaged, the components develop a stored energy that increases the rate at which the needle and armature assembly 120 moves away from the inlet member 24 when current flowing through the coil assembly is decreased. That is, the components provide a force, which appears to be a spring force, to the armature and needle assembly 120 that decrease closing time of the needle 68 on the seat 64. This force is created in the components due to the momentum created when the first surface 100 engages the second surface 104. Experimental tests on fuel injectors having a first surface 100 and a second surface 104 that engage in the disclosed manner demonstrate a substantially improved closing time. In particular, test results of fuel injectors with a first surface 100 and second surface 104, and the armature spring in a non-calibrated status, i.e. no spring load on the armature, yield at least a 40% decrease in needle closing time.

While the invention has been disclosed with reference to certain preferred embodiments, numerous modifications, alterations, and changes to the described embodiments are possible without departing from the sphere and scope of the invention, as defined in the appended claims and their equivalents thereof. Accordingly, it is intended that the invention not be limited to the described embodiments, but that it have the full scope defined by the language of the following claims.

I claim:

1. A fuel injector comprising:

a housing having a fuel inlet, a fuel outlet, and a fuel passageway extending from the fuel inlet to the fuel outlet along a longitudinal axis;

an inlet member disposed within the fuel passageway;

an armature disposed within the fuel passageway, the armature having a central axis;

a needle operatively connected to the armature, the needle being positionable to permit or inhibit fuel flow through the fuel outlet;

a first surface located on one of the inlet member and the armature, the first surface having a first perimeter located on a first plane that is substantially perpendicular to the longitudinal axis; and a second surface exposed to the first surface, the second surface being located on the other of the inlet member and the armature, the second surface having a second perimeter at least partially located on a second plane that is oblique to the longitudinal axis and the second plane engages a first position and a second position on opposing sides of the second perimeter, such that the first surface and the second surface engage so that the central axis is non-liner and the central axis is at least partially offset from the longitudinal axis of the fuel injector.

2. The fuel injector of claim 1, wherein the second surface comprises an engagement face and a relieved face.

3. The fuel injector of claim 2, wherein the second perimeter lies on both the engagement face and the relieved face, and wherein the first position is disposed on the engagement face and the second position is disposed on the relieved face.

4. The fuel injector of claim 3, wherein the engagement face comprises a planar surface that is substantially perpendicular to the longitudinal axis.

5. The fuel injector of claim 4, wherein the relieved face comprises at least one of: (1) a planar surface that is offset along the longitudinal axis and substantially parallel to the planar surface of the engagement face; and (2) a planar surface that is oblique to the longitudinal axis.

6. The fuel injector of claim 5, wherein the first surface is disposed on the inlet member and the second surface is disposed on the armature.

7. The fuel injector of claim 6, wherein the inlet member comprises an entrance, an exit, and an inlet passage extending from the entrance to the exit along the longitudinal axis; wherein the first surface being proximate the exit.

8. The fuel injector of claim 7, wherein each of the first perimeter of the first surface and the second perimeter of the second surface comprises a circular configuration.

9. The fuel injector of claim 8, wherein each of the engagement face and the relieved face comprises a sector.

10. The fuel injector of claim 1, wherein the armature comprises a substantially cylindrical member having a first end surface, a second end surface, a plurality of sections between the first end surface and the second end surface that provide a side surface, the first end surface including the engagement face and the relieved face on the second surface.

11. The fuel injector of claim 1, wherein the housing comprises an overmolded plastic member cinturing a metallic support member and a body shell; and wherein a body extends from the body shell, the body shell having an inlet, an outlet that serves as the outlet of the fuel injector, and a body passage extending from the inlet to the outlet.

12. The fuel injector of claim 11, further comprising a swirl generator proximate the seat, the swirl generator including a flat swirl generator disk and a flat guided disk.

13. The fuel injector of claim 12, wherein an armature guide eyelet is located at the inlet of the body, the armature guide eyelet configured to allow fluid communication between the armature guide eyelet and the side surface of the armature.

14. A method of mechanically enhancing motion of components of a fuel injector, the fuel injector including a housing having a fuel inlet, a fuel outlet, and a fuel passageway extending from the fuel inlet to the fuel outlet along a longitudinal axis; an inlet member that provides the fuel inlet; an armature and needle assembly being is disposed within the passageway, the armature and needle assembly having a central axis substantially aligned with the longitudinal axis; a first support member for the armature; and a second support member for the needle, the method comprising:

providing an armature guide eyelet as the first support member;

providing at least one flat guide disk as the second support member;

providing a first surface on the inlet member;

providing a second surface on the armature;

arranging an engagement face and a relieved face on the second surface, the engagement face being a planar surface that is substantially perpendicular to the central axis, the relieved face comprises at least one of: (1) a planar surface that is offset along the longitudinal axis and substantially parallel to the planar surface of the engagement face; (2) a planar surface that is oblique to the longitudinal axis; and engaging the first surface and the second surface so that the central axis is at least partially offset from the longitudinal axis of the fuel injector.

15. The method of claim 14, further comprising:

providing the flat guide disk proximate a flat swirl generator disk.

* * * * *